United States Patent [19]

Thomas

[11] 4,083,598

[45] Apr. 11, 1978

[54] COLLAPSIBLE WHEELCHAIR

[75] Inventor: Morton I. Thomas, Nyack, N.Y.

[73] Assignee: Temco Products, Inc., Passaic, N.J.

[21] Appl. No.: 755,753

[22] Filed: Dec. 30, 1976

[51] Int. Cl.[2] ..... A47C 4/42

[52] U.S. Cl. ..... 297/45; 297/DIG. 4; 297/440

[58] Field of Search ..... 297/DIG. 4, 42, 44, 297/45, 440

[56] References Cited

U.S. PATENT DOCUMENTS

| | | | |
|---|---|---|---|
| 2,460,459 | 2/1949 | Kraska | 297/DIG. 4 |
| 2,621,711 | 12/1952 | Leslie | 297/44 X |
| 2,914,111 | 11/1959 | Mize | 297/45 |
| 2,930,429 | 3/1960 | Mize | 297/DIG. 4 |
| 3,021,889 | 2/1962 | Mize | 297/440 X |
| 3,123,397 | 3/1964 | Murcott | 297/DIG. 4 |
| 3,321,239 | 5/1967 | Cosper | 297/440 X |
| 3,512,187 | 5/1970 | Thomas | 297/DIG. 4 |
| 3,584,890 | 6/1971 | Presty | 297/DIG. 4 |
| 3,853,372 | 12/1974 | Meyer | 297/DIG. 4 |

FOREIGN PATENT DOCUMENTS

| | | | |
|---|---|---|---|
| 436,701 | 7/1948 | Italy | 297/45 |

*Primary Examiner*—Francis K. Zugel
*Attorney, Agent, or Firm*—Richard C. Woodbridge

[57] ABSTRACT

A rugged, lightweight wheelchair may be readily disassembled and packed into a relatively small size shipping container. The back and footrest sections include push-button release elements which separate those sections from the side frames of the chair. The side frames are connected to each other through a scissors mechanism which allows the chair to collapse sideways. The disassembled parts can very easily be placed into a regulation size shipping container. A strong steel spine which includes two welded portions gives the side frames extra strength. Most of the rest of the chair is made up of lightweight metals and fabrics. The front wheels of the wheelchair include a bracket and pin combination which reduces undesirable twisting moments. The wheelchair also includes other improved features which make it exceptionally rugged for a device of such lightweight construction.

13 Claims, 13 Drawing Figures

COLLAPSIBLE WHEELCHAIR

BACKGROUND OF THE INVENTION

1. Field of the Invention

This invention relates to the wheelchair art.

2. Description of the Prior Art

There are many different types of wheelchairs known to those of ordinary skill in the wheelchair art. One of the problems with prior art wheelchairs is that they are not adapted for easy shipping. Conventional wheelchairs are too bulky to be sent by special commercial carriers such as United Parcel Service. Prior art wheelchairs tend to be too heavy because they are constructed of heavy materials such as steel. Such wheelchairs tend to be bulky because in order to be rigid it is often undesirable to include collapsible connections. Accordingly, a wheelchair was desired which was light enough and small enough to be placed in a small size shipping container, yet rigid enough to stand up to the daily abuse that the average wheelchair receives.

SUMMARY OF THE INVENTION

Briefly described the present invention comprises a lightweight, collapsible wheelchair which has superior rigidity when in the erected state. The wheelchair includes a detachable back and a pair of detachable foot rests which when removed allow the rest of the assembly to be collapsed and placed in a United Parcel Service size shipping container. The wheelchair includes a pair of side frames connected together by a scissors-like mechanism. Each of the frames include a steel spine to which many of the key elements of the wheelchair are attached. The spine includes a welded bushing therein adapted to receive the axle of the rear wheels. The steel spine also includes an extension welded thereto over which a tubular arm rest member is connected. Besides the steel spine the wheelchair includes other features which give it additional rigidity. The front wheels are braced in such a fashion as to prevent the frame and the front wheels from twisting. The footrest section of the wheelchair is partially connected to the frame through an abutted, flattened tubular member which helps to absorb shocks to the foot rest. A toggle brake is employed to keep the chair from rolling and is connected to a transversely disposed tubular member through a pair of bolts. The tubular member is heavily indented at the location where the brake supporting bolts are attached so as to improve rigidity and to prevent the head of the bolt from being pulled though the tubular member itself. It has also been found that by indenting the tube there is less likelihood of skinning the knuckles. An improved and simplified skirt guard is employed to protect clothing from the wheels and to make the construction of the wheelchair considerably lighter. The seat of the wheelchair is connected to the scissor-like means that connect the two side frames. The seat fabric has a pocket-like shape and, includes a pair of dowels along two edges which are adapted to be received in a hollow tubular member having a slot therethrough. The slot is larger in width than the depth of the fabric, but smaller than the diameter of the dowel when situated in the fabric. The improved wheelchair construction thus described allows for the maximum use of lightweight materials such as aluminum thereby considerably reducing the necessity of using heavier materials such as steel. According to the present invention steel is used only where necessary, such as in the spine portion of the wheelchair.

These and other features and advantages of the present invention will be more fully understood with reference to the following drawings and detailed description of the invention.

DETAILED DESCRIPTION OF THE INVENTION

During the course of this disclosure like numbers will be used to illustrate like elements according to the different views which illustrate the invention.

Figure 1A:
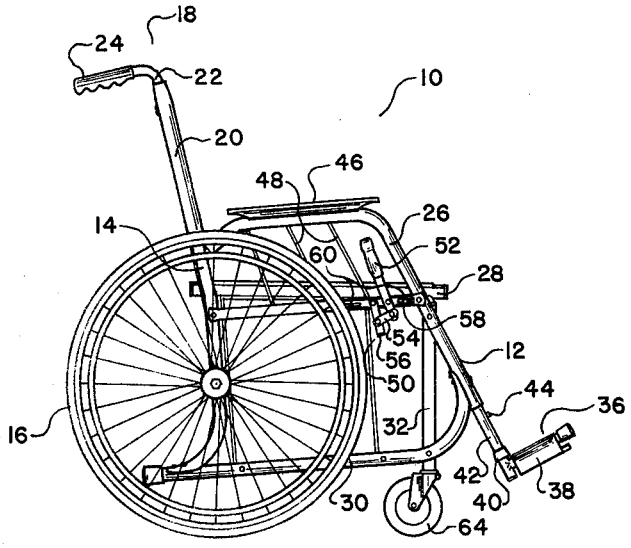
FIG. 1*a* is a side elevational view of an erected wheelchair according to the preferred embodiment of the present invention.

The wheelchair 10 according to the preferred embodiment of the present invention is shown in a side elevational view in FIG. 1*a*. The wheelchair 10 includes a side frame generally designated as element 12 which supplies support for the various different basic parts of the apparatus 10. A steel spine 14 which is described in greater detail with reference to FIG. 3 provides additional rigidity to the side frame. Where possible most of the rest of the elements of the wheelchair are made of lightweight anodized aluminum. However, there are ceratin other elements which by necessity must be constructed of stronger heavy metals.

A conventional wheelchair wheel 16 is attached to the spine 14. The axle of rear wheel 16 passes through a welded tubular bushing in the spine 14. The bushing is partially tapped to accommodate the threads on the axle stud. A nut is employed on the other side of the spine 14 to secure the threaded axle stud to the spine 14.

A back support means generally indicated as element 18 is releasably connected to the top of the spine 14.

Back support includes a fabric portion 20, a tubular handle member 22 and a plastic handle grip 24. One important feature of the present invention is that the handle grip 24 does not extend further back than the rear wheel 16. This feature will be readily appreciated from FIG. 1*a*. Accordingly, when the wheelchair backs into a flat surface, such as a wall, the rubberized wheel 16 will absorb the impact rather than the back of the chair 18. This is desirable in order to avoid injury or discomfort to the individual sitting in the wheelchair. The top of the spine 14 is provided with a spring-loaded pushbutton 88 which is adapted to mate with a hole 90 near one end of tubular handle 22. The back support 18 is connected to the spine 14 by forcing the handle 22 over the top end of spine 14 until the spring-loaded button 88 pops into the corresponding opening 90 in tubular handle 22. The back support 18 can be removed by reversing the process wherein the spring-loaded pushbutton 88 is depressed and the two members are slipped apart. Normally the back fabric 20 covers the pushbutton release when the wheelchair is in its erected state.

Figure 1B:
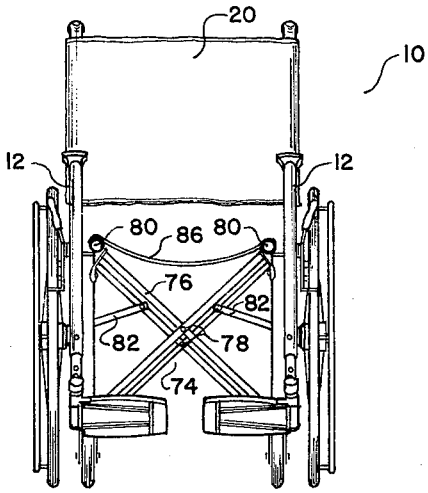
FIG. 1*b* is a front view of the wheelchair illustrated in FIG. 1*a*.

As can be seen in FIG. 1*b* the wheelchair 10 includes a pair of side frames 12. Each side frame 12 in turn includes a plurality of elements which give the wheelchair stability and strength. Side frame 12 as shown in FIG. 1*a* includes first tubular member 26, second tubular member 28, third tubular member 30 and fourth tubular member 32. The first tubular member is connected at one end to a stud 34 welded to spine 14. Welded stud 34 may be seen in greater detail in FIG. 3. The first tubular member 26 extends from spine 14 to the footrest 36. Footreset 36 includes a foot support section 38, a right-angle bracket 40, and a tubular sleeve 42. Tubular sleeve 42 is riveted to one end of the first tubular member 26. Sleeve 42 includes a plurality of holes therein which are adapted to receive a spring-loaded pushbutton 44. The spring-loaded pushbutton 44 is carried by bracket 40. The positioning of the footrest 36 can be varied by depressing pushbutton 44 and relocating it at any one of a plurality of suitble locking holes in sleeve 42. The foot support section 38 is adapted to swivel upwardly 90° and out of the way during the collapsing operation. The foot support section 38 is conventional in this respect. The first tubular member 26 also provides support to an arm rest pad 46 which is preferably made out of a suitable plastic material. Arm rest pad 46 is connected to the first tubular member 26 by a screw means.

The second tubular member 28 is riveted at one end thereof to spine 14 and at the other end thereof to the first tubular member 26. The second tubular member 28 is approximately parallel to arm rest 46 and also parallel to the ground. A plurality of rod-like elements 48 extend diagonally from the first tubular member 26 to the second tubular member 28. Both tubular members 26 and 28 include holes therein which are adapted to receive rods 48. The rods 48 serve as a skirt guard to prevent the clothing of the wheelchair user from coming into contact with revolving rear wheels 16. The skirt guard just described is an improvement over prior art skirt guards which tended to comprise a heavy flat metal sheet which extended from the base of the seat to the arm rest and across the width of the seat. It has been discovered that such prior art skirt guards are not only heavy but they are also unnecessary. A toggle brake 50 is bolted to the second tubular member 28. According to the illustration of FIG. 1*a* the toggle brake 50 is shown in its braking mode. Brake 50 is placed in its braking mode by pushing handle 52 forward. The forward movement of handle 52 is transmitted through link 54 to brake shoe 56 which impinges against the rubber tread of rear wheel 16. The over-center toggle nature of brake 50 insures that the brake does not accidentally come out of its braking mode. In order to release the break the handle 52 is pulled backwardly thereby removing brake shoe 56 from the tread of rear wheel 16. Toggle break 50 is connected to the second tubular element 28 by a bracket 58. A pair of bolts 60 connect the bracket 58 to the second tubular member 28. Second tubular member 28 is flattened to form indentations 62 on the inside of the side frame at the locations where the bolts 60 emerge through the tubing. This feature is illustrated in more detail in FIG. 5. The indentations 62 serve two major purposes. First of all, they prevent the head of the bolt from pulling through the tubing. The bolt cannot pull through the tubing when the tubing is collapsed. Secondly, they serve to protect the user of the wheelchair from skinning his knuckles when his hand is in the vicinity of the inside of the frame. The head of the bolts 60 are located within indents 62 in such a fashion as to minimize their profile. The bolts 60 are attached on the outside of side frame 12 to the toggle brake bracket 58 with a pair of conventional nuts.

The third tubular element 30 is riveted at one end to the first tubular element 26 and at the other end to the bottom portion of spine 14. The end of the third tubular member 30 which contacts the first tubular member 26 is flattened and rounded in such a fashion as to abut the first tubular member 26 about 10 inches above the foot support pads 38. Accordingly, the third tubular element 30 is slightly bent back on itself and contacts the first tubular member 36 over a relatively wide area. In this manner the third tubular element 30 is specially adapted to absorb the impact which might occur against foot rest 36. The bottom or base end of spine 14 is likewise flattened and curved in a manner simlar to that just described with reference to tubular member 30. That portion of the base of spine 14 is connected with a pair of rivets to the third tubular member 30. The curved and rounded portions of spine 14 and tubular member 39 effectively cradle the members to which they are attached. This technique has been discovered to be most effective in increasing rigidity and strength.

Figure 4A:
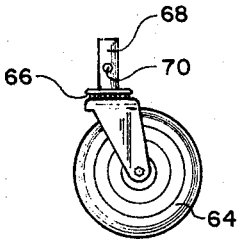
FIG. 4*a* is a detailed view of the front wheel of the present invention illustrating a pin receiving hole through the stud thereof.
Figure 4B:
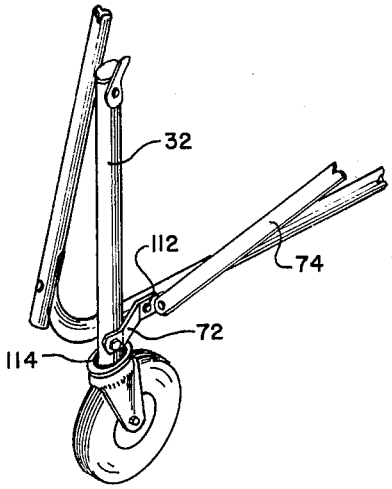
FIG. 4*b* is a detailed perspective view of the bracing of the front wheels.

The fourth tubular member 32 is riveted near its top end to the first tubular member 26 and near its base end to the third tubular member 30. The fourth tubular member 32 is adapted to act as a support for front wheels 64. As may be seen in detail in FIG. 4*a*, the front wheels 64 include a conventional swivel section 66 and a short stud section 68. A hole 70 passes directly through the shaft of stud 68. Stud 68 is adapted to be received in the hollow base of the fourth tubular member 32. According to the preferred embodiment a bolt passes through bracket 72, fourth tubular member 32, hole 70 and third tubular member 30 where it emerges on the other side and is fastened thereto with a conventional nut. Bracket 72 serves a very important function in that it greatly reinforces the front wheels 64 and protects the fourth tubular member 32 from severe twisting moments.

Figure 1C:
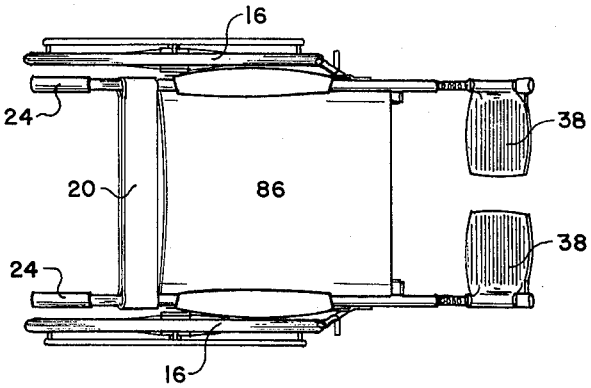
FIG. 1*c* is a top view of the wheelchair illustrated in FIGS. 1*a* and 1*b*.
Figure 6A:
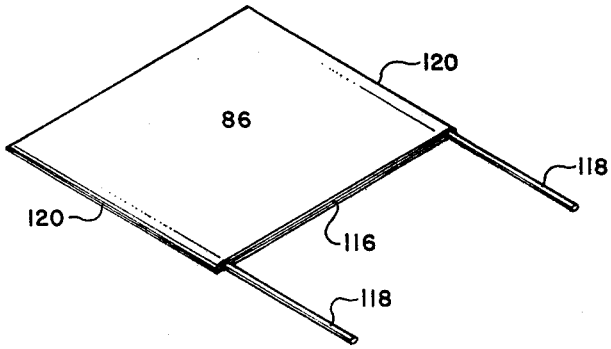
FIG. 6*a* is an exploded perspective view of the seat fabric and the dowel members that are included in the edges thereof.
Figure 6B:
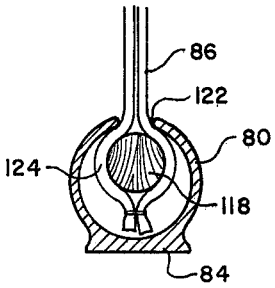
FIG. 6*b* is an end view of the extruded hollow member which connects the seat fabric to the collapsible scissors portion of the wheelchair.
Figure 6C:
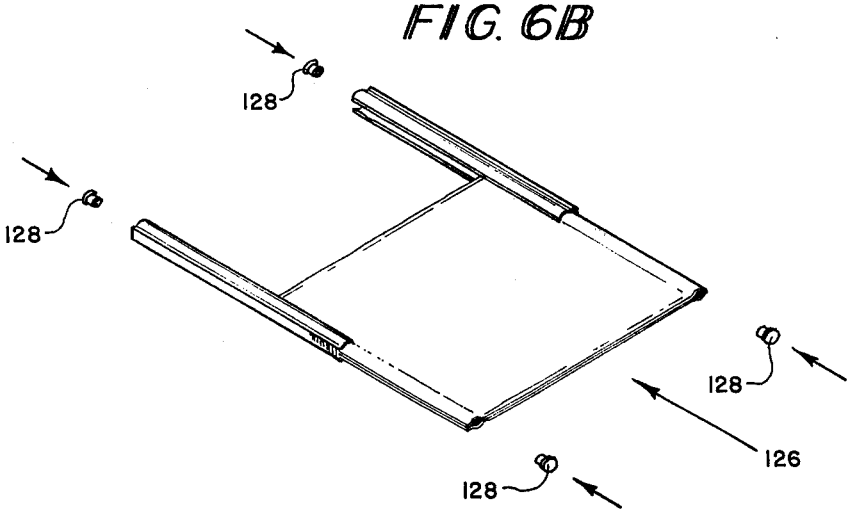
FIG. 6*c* illustrates the elements of FIGS. 6*a* and 6*b* in their assembled state.

FIG. 1*b* illustrates the manner in which the side frames 12 are connected together by a scissor-like linkage system 74. Collapsible scissor-linkage system 74 is similar to conventional panaographic or lazy tongue linkage system. Linkage system 74 incudes a pair of cross-links 76 which pivot about a common point 78. According to the preferred embodiment there are actually two sets of scissor linkages 74. The first set is pivotally connected at the bottom end thereof to a tab on bracket 72. Bracket 72 is in turn connected by a rivet near that point to the third tubular member 30. One important feature of the invention is that bracket 72 serves not only as a reinforcement for the fourth tubular member 32 but it also serves as a strong anchor for one end of the front cross-link members 76. Typically bracket 72 is made out of steel and since it is securely riveted at two points to the third tubular member 30, it serves as an excellent anchor for the base pivot of cross-links 76. The top ends of cross-links 76 are connected to an extruded hollow tubular member 80 which is shown in more detail in FIG. 6*b*. The back scissor linkage 74 is also connected at the upper end of the cross-links 76 to the same extruded tubular member 80 as illustrated in FIG. 6*b*. The other end of the back set of cross-links 76 is pivotally connected to a tab riveted to the third tubular member 30. The rear tab, which is not illustrated in the drawing, serves the sole function of supporting the rear set of scissor links. As illustrated in FIG. 1*b* a pair of guide links 82 are pivotally connected at one end to spine 14 and at the other end to the upper portion of the rear cross-links 76 at a point intermediate pivot point 78 and extrusion 80. According to the preferred embodiment of the present invention, the front and back scissor linkage systems 74 may comprise a pair of crossed U-shaped members. The links are preferably flattened aluminum members measuring about ¾ wide and approximately 3/16 inch thick. When a pair of U-shaped members are used to form the front and back scissor linkages, they are usually connected in the following manner. The first U-shaped bracket is pivotally connected to bracket 72 which in turn is riveted to the third tubular element 30 of the first side frame 12. The first U-shaped bracket then extends diagonally up to split, extruded member 80, thus forming the first arm of the bracket. The U-shaped bracket is then bent and extends across the length of extrusion 80 thereby forming the bottom of the U-shaped bracket. The remaining arm of the U-shaped bracket extends from the extrusion 80 and terminates in the rear tab riveted to the same third tubular element from which it began. In a similar manner, the second U-shaped bracket begins with the third tubular element of the second side frame, goes up to the other extension 80, across extrusion 80 and back to the same third tubular element 30 where it began. As can be seen in FIG. 6*b* the extruded element 80 includes a flat base portion 84. The base of the scissor linkage U-shaped brackets are flat and adapted to be screwed into the base 84 of the extruded tubular member 80. According to the preferred embodiment there might be three holes in the base 84 which correspond to three holes in the base of each of the two U-shaped scissor brackets. A machine screw is then used to connect the U-shaped scissor brackets to the extruded tubular member 80. This has been found to be a very effective way in which to connect the extruded member 80 to the U-shaped scissors brackets. The function of the extruded tubular members 80 is to support the seat fabric 86 in a manner which will be described subsequently in more detail with reference to FIGS. 6*a* to 6*c*. FIG. 1*c* illustrates many of the element of wheelchair 10 as seen from the above in a top plan view.

Figure 2A:
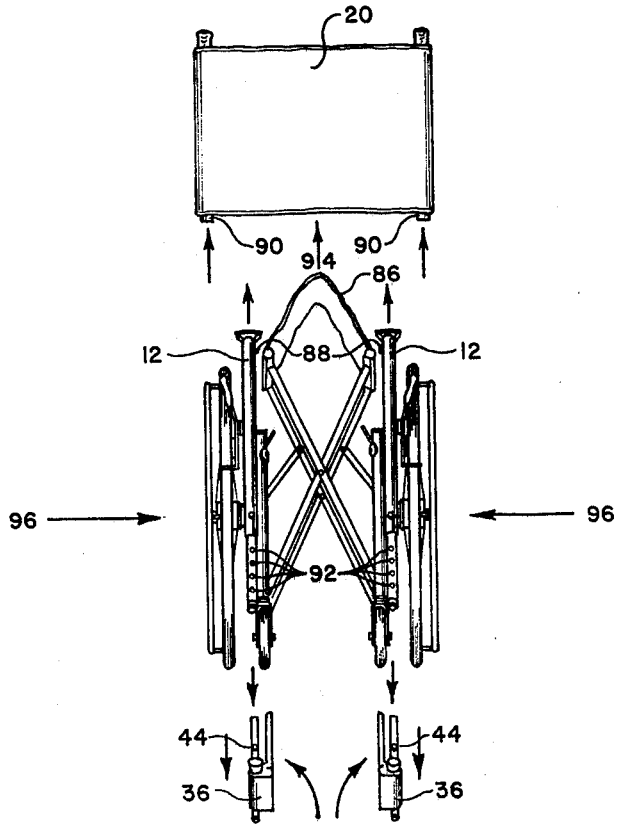
FIG. 2*a* is an exploded front view of the wheelchair in a partially collapsed state with the back support and footrest portions illustrated in their detached mode.
Figure 2B:
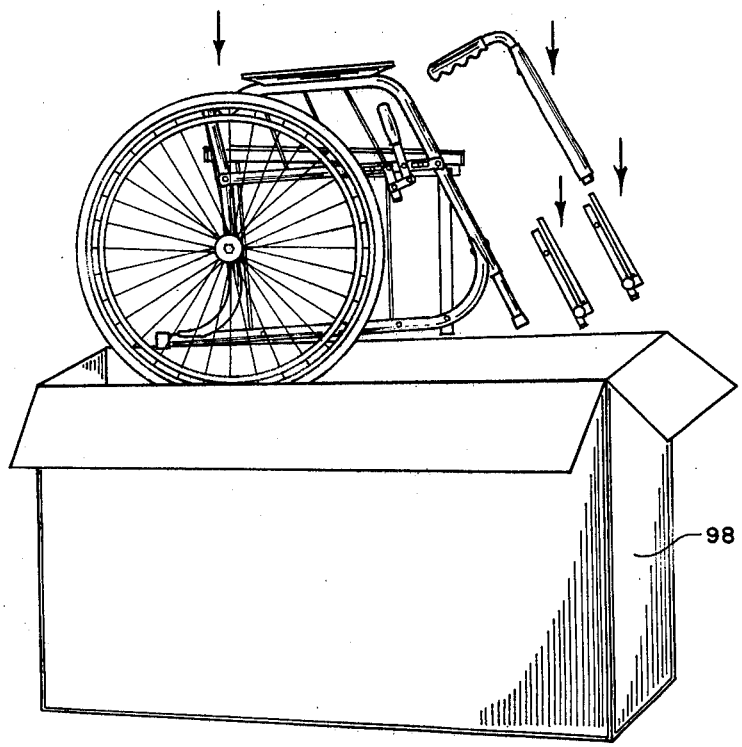
FIG. 2*b* illustrates the manner in which a collapsed wheelchair may be packaged in a shipping container.

FIGS. 2*a* and 2*b* illustrate the manner in which the wheelchair 10 of the present invention may be disassembled and packed into a standard size shipping carton. As shown in FIG. 2*a*, the back support 18 can be removed by depressing pushbuttons 88 which are adapted to be received in indents 90. Pushbuttons 88 may be depressed through the back fabric 20 and in the manner disengaged from the indents 90 by simultaneously pulling up on the handle grips 24. One side of the back support can be released at one time. Pushbutton 88 and indents 90 form a first release means for detaching the back support 18. In a similar manner spring-loaded pushbuttons 44 are adapted to be received in any one of a plurality of indents 92. The footrests 36 may be individually separated from the two wheelchair side frames by depressing the pushbutton 44 and pulling the footrest 36 away from the wheelchair frame. Spring-loaded pushbuttons 44 and their corresponding indentations 92 form a second release means which acts in a manner very similar to that of the first release means. Once the back support 18 and the two footrest sections 36 are removed, the body of the chair may be collapsed by pulling upwardly on the fabric 86 of the seat in the direction of arrow 94. This causes the scissor linkages to draw the side frames together in the direction of arrows 96 until the main body of the wheelchair is completely collapsed. For convenience the two handle brackets 22 of the back support 18 are usually rolled up in the back support fabric 20 in order to preserve space in the manner shown in FIG. 2*b*. The wheelchair 10 collapsed in the manner just described may be readily packed into a regulation size shipping container. The container illustrated in FIG. 2*b* measures approximately 12 inches wide × 33 inches long and 27 inches deep. Carriers such as United Parcel Service will readily accept shipping cartons of such dimensions. The wheelchair in its collapsed or non-collapsed state weighs about 37 lbs. This is considerably lighter than many conventional wheelchairs which employ greater amounts of steel and other heavy metals. Anondized aluminum is preferred for the non-steel elements because of superior weight characteristics.

Once the shipping container 98 reaches its destination, the wheelchair components are unpacked and easily assembled to form the wheelchair 10 described in FIGS. 1*a* through 1*c*. The wheelchair is erected by pulling the two side frames 12 apart and then attaching the footrests 36 so that pushbuttons 94 engage in any one of the indentations 92 and then attaching the back support 18 so that the pushbuttons 88 are engaged in receiving holes 90. It is clear from the foregoing that the wheelchair 10 can be assembled and disassembled in a very short period of time.

Figure 3A:
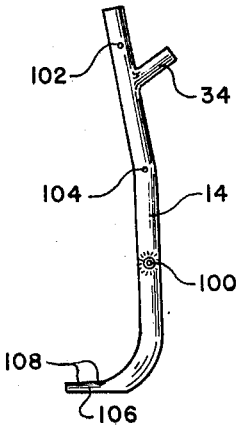
FIG. 3*a* is an elevational side view of the spine of the wheelchair illustrating two welded portions thereof and a flattened base section.
Figure 3B:
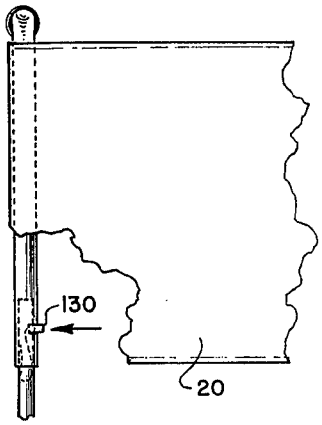
FIG. 3*b* is a partial cut-away view of the back of the wheelchair illustrating the location of the handle release pushbutton.

The steel spine 14 is illustrated in detail in FIG. 3*a*. The spine 14 is made of steel since it supports so much of the structure of the wheelchair. Welded stud 34 projects from spine 14 and supports one end of the first tubular element 26 in the manner previously described. A bushing 100 is brazed onto the steel structure and passes directly therethrough. Bushing 100 forms an aperture which is adapted to receive an extension of the axle of rear wheel 16. Accordingly, welded stud 34 and brazed bushing 100 comprise the only welded portions of the spine 14. One important feature of the present invention is the the welding operations have been held to a minimum thereby greatly reducing the amount of time and material necessary to construct this collapsible wheelchair. Prior art wheelchairs tend to require a large number of welded connections. The two welds on the spine 14 also tend to keep the spine from twisting. A hole 102 in the top of spine 14 is adapted to house spring-loaded pushbutton 88. Tubular handle member 22 includes a hole therein which receives pushbutton 88 when the handle is locked in position as shown in partial cutaway view in FIG. *3b*. Normally pushbutton 88 is not visible because the fabric of the back support 20 covers it when the wheelchair is assembled. A second hole 104 serves as a rivet connecting point for a second tubular member 28. As previously described the base or bottom end 106 of the spine 14 is flattened and curved in a longitudinal direction so as to conform to the outside diameter of the third tubular elememt 30. Two rivets then pass through rivet holes 108 and firmly abut the spine 14 to the third tubular member 30. The curved shape of the base 106 causes it to securely cradle its support. The brazed bushing 100 may be at least partially threaded to receive the axle extension of rear wheel 16. The spine 14 provides the basic support for the side frames of the wheelchair 10. According to the preferred embodiment of the present invention, the spine 14 includes the only two welded portions 34 and 100 of the wheelchair 10. Most of the rest of the connections are made by means of rivets, nuts and bolts or pushbuttons. The use of steel spine 14 has greatly similified the rest of the structure of wheelchair 10.

Details of the front wheel 64 and its attachment means may be seen in FIGS. *4a* and *4b*. The structure illustrated in FIG. *4b* is important because it greatly increases the strength of the wheelchair as a whole. The particulars of the structure illustrated in FIGS. *4a* and *4b* have been completely described with reference to FIGS. *1a* and *1b*. However, FIG. *4b* illustrates the important features more fully. In particular, it will be noted that bracket 74 includes a rear tab 110 which is pivotally connected to one of the front set of cross-links 74. Bracket 72 is riveted at location 112 to the third tubular member 30. A bolt 114 attaches the other end of bracket 72 to the fourth tubular member 32. The head of bolt 114 may be seen in FIG. *4b*. As previously described, bolt 114 passes through bracket 72, through the forth tubular member 32, through opening 70 in wheel stud 68, and further through the third tubular member 30 and is fastened on the outside of the side frame with a conventional nut. Bolt 114 serves as a double shear pin and in conjunction with bracket 72 keeps the tube 32 and thus the front wheel 64 from twisting under high impact loads. Since the bracket 72 is very securely attached to the side frame of the wheelchair 10 it serves as an excellent platform on which to mount a pivot for the crosslink members 76. Therefore, bracket 72 serves the dual purpose of providing double shear protection against the twisting of the front wheels and also serves an an anchor at location 110 for the pivot portion of cross-links 76.

Figure 5:
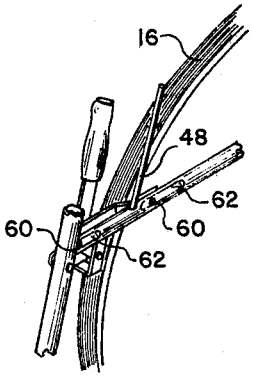
FIG. 5 is a detail of the toggle brake supporting apparatus showing a pair of bolts situated in indented portions of the tubular aluminum frame.

The toggle brake mounting is shown in detail in FIG. 5 as seen from inside of the side frame of the wheelchair. The details of the toggle brake mounting have been discussed fully with respect to FIGS. *1a* through *1c*.

FIGS. *6a* through *6c* illustrate the manner in which the seat cover 86 is attached to split, extruded tubular member 80. As shown in FIG. *6a*, the seat fabric 86 includes a hollow pocket portion 116 therein. The pocket is formed by taking a piece of material and folding it over and then sewing all but one seam closed. A pair of rounded dowels 119 are then inserted along two edges 120 of the seat fabric 86. The seat fabric 86 in its sewn together form has an approximately square shape when seen from above. The fabric 86 for seat cover and for the back support 20 preferably comprises a plasticized canvas material. However, it is well known to those of ordinary skill in the art that other materials might be just as suitable. A cross-section of extruded member 88 is illustrated in FIG. *6b*. The extruded member includes a flat base portion 84 whose function was previously described. The extruded tubular member 80 also includes a longitudinal split 122 and a hollow generally circular cavity 124. The width of slot 122 is preferably smaller than the diameter of dowell 118 or at least smaller than the diameter of the dowell 118 when encased with the seat fabric 86. On the other hand, the cavity 124 must be larger than the diameter of dowell 118 and at least a little bit larger than the diameter of dowell 118 when covered by seat fabric 86. As illustrated in FIG. *6c* the seat fabric 86 is attached to the tubular extrusions 80 by slipping the fabric enclosed dowels 118 in the direction 126 so that the dowels 118 are entrapped in channel 124 of extrusion 80. The assembly is then secured in the extrusion 80 by a set of front and rear plastic caps 128. As previously described, the flat base 84 of the extrusions 80 is adapted to be attached to the scissor linkage system 74 by a plurality of machine screws. The opening 116 preferably faces the rear of the wheelchair.

The wheelchair 10 just described is very rigid yet may be collapsed to a very small size for shipping purposes. The two welds on the spine 14 tend to keep the spine from twisting and also eliminate the necessity of other welded connections. This makes it much easier to construct the rest of the wheelchair. Where possible anodized aluminum is used in other portions of the frame construction.

While the invention has been particularly shown and described with reference to the preferred embodiment thereof, it will be understood by those skilled in the art that various changes of form and detail may be made therein without departing from the spirit and scope of the invention.

I claim:

1. A lightweight collapsible wheelchair comprising:

a pair of side frames;

a collapsible means connecting said pair of side frames;

a seat means located between said side frames, and supported by said wheelchair;

a pair of footrests each connected respectively to one of said side frames;

wheel means connected to each of said side frames, said wheel means including a pair of smaller front wheels and a pair of larger rear wheels each including an axial extension thereon, each side frame including one front wheel and one rear wheel connected thereto; and a back support connected to said side frames, wherein each side frame further includes:

a tubular steel spine having an aperture therein to receive the axial extension of one of said larger rear wheels;

a first tubular element which extends from said spine to said footrest and also serves as an arm rest, said spine including an extension thereon which is adapted to be received in one end of said first tubular element;

a second tubular element which extends from said spine to a location on said first tubular element;

a third tubular element extending from said first tubular element to said spine and located below said second tubular element, so that the end of said spine which makes contact with said third tubular element is flattened and curved so that it abuts against said third tubular element and at least partially cradles said third tubular element, a fourth tubular element which extends vertically from said tubular element and is connected to said first and third tubular elements;

a swivel axel means connected to said front wheels and including a stud attached thereto, said stud including a pin receiving hole therethrough;

a bracket means for reinforcing said front wheels against twisting loads, said bracket means being rigidly connected at one end to said third tubular element by a conventional attaching means; and, a pin means which passes through said bracket means, said third tubular element, said fourth tubular element and the hole in said stud means in order to rigidly secure said front wheels to said side frames.

2. The wheelchair of claim 1 further including:

a tab means located on said bracket means, said tab means including a rotatable attachment means for connecting said collapsible means to said third tubular element.

3. The wheelchair of claim 1 including skirt guard section which includes a plurality of rod elements which extend between said first and second tubular elements.

4. The wheelchair of claim 1 wherein the end of said third tubular element which is connected to said first tubular element is flattened so as to abut said first tubular element and absorb impact to said footrest.

5. The wheelchair of claim 1 wherein the collapsible means connecting said side frames comprises a scissors-like means and further wherein said scissors-like means and further wherein said scissors-like means directly support said seat means.

6. The wheelchair of claim 5 wherein said seat means includes a seat fabric having a rod-like element running along two edges thereof.

7. The wheelchair of claim 6 wherein said scissor-like means is connected to and carries a pair of hollow tubular elements thereon, said hollow tubular elements including a slot therethrough having an opening therein which is larger in size than the thickness of the seat fabric but smaller than the thickness of said seat fabric at the edges which include said rod-like elements, whereby the seat means may be slid into said split tubular elements and secured therein by a cap-like means.

8. The wheelchair of claim 1 further including:

a toggle brake means connected to said second tubular element and adapted to selectively brake said rear wheel in response to manual pressure.

9. The wheelchair of claim 8 wherein said toggle brake is attached to to said second element by a nut and bolt means, said second tubular elements including indented portions therein adapted to receive said bolt means, said indents being sufficiently deep so as to flatten one wall of said second tubular element against the other.

10. The wheelchair of claim 1 wherein said back support includes a pair of handle means adapted to be received by said spines and a fabric portion which extends across said handle means, said handle means being bent at the top portion thereof in such a manner that when said wheelchair is in the upright position, said rear wheel means extend backwardly further than said handle means.

11. The wheelchair of claim 1 wherein substantially all of the elements of the wheelchair except the spine consist of lightweight metals and fabrics.

12. The wheelchair of claim 1 further including:

a first release means for disconnecting said back support from said side frames; and, a second release means for disconnecting said footrests from said side frames.

13. The wheelchair of claim 1 wherein said axial extension receiving aperture in said spine includes a bushing welded into said spine and the extension on said spine adapted to be received in said first tubular element is welded tp said spine.

* * * * *